United States Patent [19]

Lewandowski

[11] Patent Number: 4,551,953

[45] Date of Patent: Nov. 12, 1985

[54] MACHINE TOOL WITH DETACHABLE TOOL SHIELDING MEANS

[75] Inventor: Willi Lewandowski, Glinde, Fed. Rep. of Germany

[73] Assignee: Hauni-Werke Körber & Co. KG., Hamburg, Fed. Rep. of Germany

[21] Appl. No.: 618,048

[22] Filed: Jun. 7, 1984

[30] Foreign Application Priority Data

Jun. 10, 1983 [DE] Fed. Rep. of Germany ..... 3320952

[51] Int. Cl.[4] ..... B24B 55/04

[52] U.S. Cl. ..... 51/268; 51/168; 29/568

[58] Field of Search ..... 51/168, 268, 272; 29/568

[56] References Cited

U.S. PATENT DOCUMENTS

| | | | |
|---|---|---|---|
| 2,804,727 | 9/1957 | Schmidt | 51/168 |
| 3,627,490 | 12/1971 | Asano | 51/168 |
| 3,925,878 | 12/1975 | Kikuchi | 29/568 |

FOREIGN PATENT DOCUMENTS 3246168 7/1983 Fed. Rep. of Germany .

*Primary Examiner*—Roscoe V. Parker
*Attorney, Agent, or Firm*—Peter K. Kontler

[57] ABSTRACT

A grinding machine wherein the spindle for one or more grinding wheels is at least partially surrounded by a two-piece protective device whose hood is secured to the machine frame and whose cover is detachable by a mechanism on a tool changing device which accepts grinding wheels from the spindle, which delivers such grinding wheels to a magazine and which attaches fresh grinding wheels to the spindle. The mechanism retracts the cover from the hood in the axial direction of the spindle as soon as a reciprocable carriage of the tool changing device assumes a tool changing position in front of the spindle. The bolts which normally lock the cover to the hood also serve for attachment of the cover to several studs of the mechanism, and such studs are movable by a fluid-operated motor to move the cover thereon in the axial direction of the spindle to and from a retracted position in which the cover is out of the way and the tool changing device is free to remove one or more grinding wheels from or attach one or more grinding wheels to the spindle as well as to move toward or away from the magazine.

17 Claims, 6 Drawing Figures

MACHINE TOOL WITH DETACHABLE TOOL SHIELDING MEANS

BACKGROUND OF THE INVENTION

The present invention relates to machine tools in general, especially to grinding machines, and more particularly to improvements in machine tools of the type wherein the holder or holders for one or more material removing or other work treating tools are surrounded by protective enclosures in the form of hoods or the like to prevent injury to attendants and/or contamination of the area around the machine. For example, such hoods are often used to confine the grinding wheel or wheels on the rotating spindle or spindles of a grinding machine in order to avoid propulsion of removed particulate material and/or spraying of a coolant or other liquid media into the area around the grinding machine.

If a grinding machine is equipped with a tool changing device, e.g., a device which can automatically or otherwise remove a grinding wheel from the spindle and replace it with one of several spare grinding wheels which are stored in a suitable magazine, the protective enclosure for the grinding wheel on the spindle must be shifted, pivoted or otherwise moved out of the way in order to afford access to the grinding wheel for the purpose of detachment from the spindle as well as to provide room for attachment of a fresh grinding wheel. This means that the space which must accommodate the enclosure during replacement of a grinding wheel remains unoccupied at all times except for the short interval which is required for an exchange of grinding wheels. On the other hand, an enclosure is necessary and is normally required in such types of machine tools for the sake of safety.

OBJECTS AND SUMMARY OF THE INVENTION

An object of the invention is to provide a machine tool, such as a grinding machine, with novel and improved means which can move and support at least a portion of a protective enclosure for the tool or tools out of the way preparatory to detachment of a tool from a rotatable spindle or another suitable tool holder.

Another object of the invention is to provide a machine tool wherein the removed portion of or the entire protective enclosure occupies space which is normally available anyway and wherein the removal of such portion of or the entire enclosure can be effected automatically in proper sequence with operations which involve replacement of a previously used tool with a fresh tool.

A further object of the invention is to provide a novel and improved mobile tool changing device for use in grinding machines or other types of machine tools.

An additional object of the invention is to provide a machine tool wherein the exposure of a normally confined tool takes up little time and wherein confinement of a freshly attached tool can also be completed within a short interval of time.

Still another object of the invention is to provide a novel and improved method of manipulating the protective enclosure or a portion thereof preparatory to, during and subsequent to replacement of one or more tools in a grinding machine or another machine tool.

Another object of the invention is to provide a novel and improved protective enclosure for use in a machine tool of the above outlined character.

A further object of the invention is to provide a novel and improved tool changing device which can be installed in existing grinding machines or other types of machine tools as a superior substitute for heretofore used tool changing devices.

An additional object of the invention is to provide a grinding machine or another machine tool with novel and improved means for releasably coupling separable components of a protective enclosure for material removing or other types of tools to one another.

The invention is embodied in a machine tool, such as a grinding machine, which comprises a frame, a tool holder (such as a rotatable spindle for one or more grinding wheels) which is mounted in the frame, a protective enclosure provided on the frame for the tool or tools on the holder, a tool changing device which is provided on the frame, means for effecting a relative movement between the tool changing device and the holder so that the device can assume with reference to the holder (or vice versa) a tool changing position in which one or more tools can be transferred between the holder and the tool changing device, and means for temporarily supporting at least a portion of the protective enclosure, during transfer of tools between the tool changing device and the holder, in a predetermined position in which the removed portion of the enclosure affords access to the holder. The supporting means is provided on the tool changing device and is movable therewith if the tool changing device is movable in the frame toward and away from the tool changing position. The supporting means can include means (e.g., one or more fluid-operated motors) for detaching the aforementioned portion of the enclosure from and for reattaching such portion to the frame. In accordance with a presently preferred embodiment of the invention, the enclosure comprises a substantially hood-shaped component which is affixed to and can be considered as an element of the frame, and the aforementioned portion of the enclosure preferably constitutes or includes a substantially plate-like cover which is normally attached to the frame by way of the hood-shaped component. The supporting means includes means for detaching such cover from the hood-shaped component preparatory to transfer of one or more tools between the tool changing device and the tool holder and for reattaching the cover to the hood-shaped component upon completed transfer of one or more tools. The supporting means can further comprise one or more substantially stud-shaped or post-shaped carriers which are provided on the tool changing device and means for engaging the carriers with and for disengaging the carriers from the cover in the tool changing position of the tool changing device. The supporting means preferably further comprises means for moving the carriers and the cover thereon toward and away from the predetermined position, preferably in the axial direction of the holder if the latter constitutes a rotatable spindle for one or more grinding wheels.

The machine tool can further comprise a tool magazine which can be mounted on the frame, and the means for effecting relative movement between the tool changing device and the tool holder can comprise a carriage which preferably forms part of the tool changing device and is movable between the tool changing position and a further position in which the tool changing device is adjacent to the magazine and is ready to exchange one or more tools with the magazine, e.g., to introduce into the magazine a tool which has been removed from the tool holder and/or to receive from the magazine one or more fresh tools for transfer onto the tool holder. The supporting means on such a tool changing device can comprise several carriers (e.g., two pairs of elongated parallel carriers) which are provided on the carriage of the tool changing device and serve to releasably support and hold the cover of the protective enclosure. The tool changing device further comprises tool retaining means (e.g., a suitable cone which can support one or more tools during transport from the tool holder to the magazine or vice versa), and the carriers can include at least one pair of parallel carriers which flank the retaining means of the tool changing device.

The machine tool can further comprise means for separably locking the cover of the protective enclosure to the hood-shaped component when the machine tool is in actual use, and the supporting means then preferably comprises means (such as the aforementioned fluid-operated motor or motors) for disengaging the locking means in the tool changing position of the tool changing device so that the detached cover is then supported and held by the carriers of the supporting means. Such supporting means preferably further comprises the aforementioned means (such as one or more fluid-operated motors) for moving the carriers and the cover thereon to and from the predetermined position. The locking means can comprise a plurality of locking members which are provided on the cover and serve to releasably secure the cover to the hood-shaped component of the protective enclosure or directly to the frame. The arrangement is preferably such that, when the locking members are disengaged from the hood-shaped component and/or from the frame, they automatically engage with the carriers of the supporting means to releasably lock the cover to the carriers which enables the carriers to move the cover to and from the predetermined position. The actuating means for the locking members can comprise a discrete fluid-operated motor for each locking member. The locking members can constitute reciprocable locking bolts which are mounted on the cover, and the cover is preferably provided with apertures for reception of the carriers in response to movement of a portion of the tool changing device and/or tool holder to the tool changing position. Coil springs or other suitable means can be provided for yieldably biasing the locking members into engagement with the hood-shaped component and/or with the frame so that the actuating means for the locking members must overcome the bias of such biasing means in the course of disengagement of locking members from the frame and/or hood-shaped component and simultaneous engagement of the locking members with the carriers of the supporting means. The biasing means can be installed in or on the cover of the protective enclosure.

The novel features which are considered as characteristic of the invention are set forth in particular in the appended claims. The improved machine tool itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
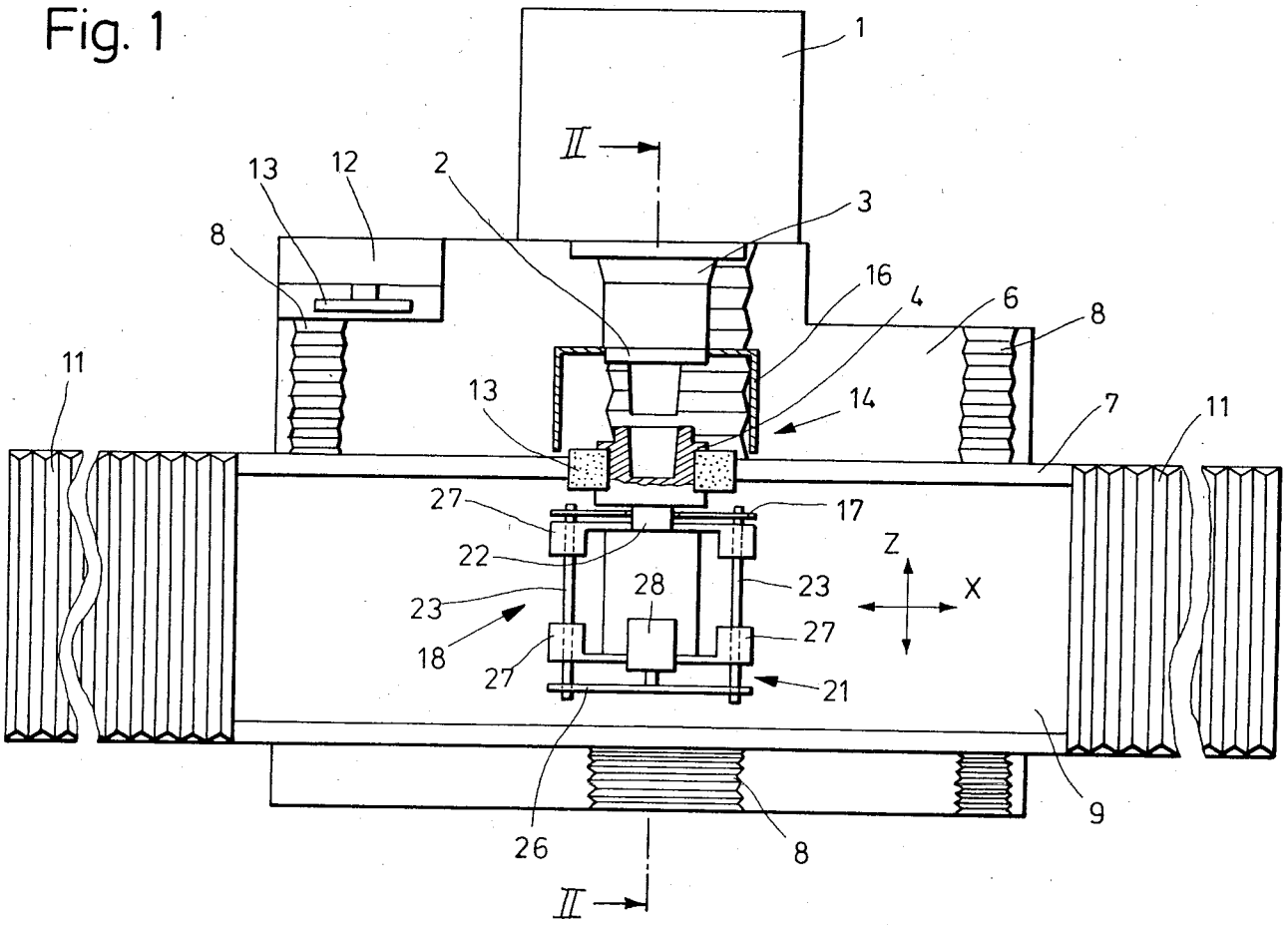
FIG. 1 is a plan view of a machine tool which constitutes a grinding machine and embodies one form of the invention, the cover of the protective enclosure being supported and held by the carriers of the supporting means and the retaining means of the tool changing device being in engagement with the hub of a single grinding wheel which is ready for transport toward the magazine.
Figure 2:
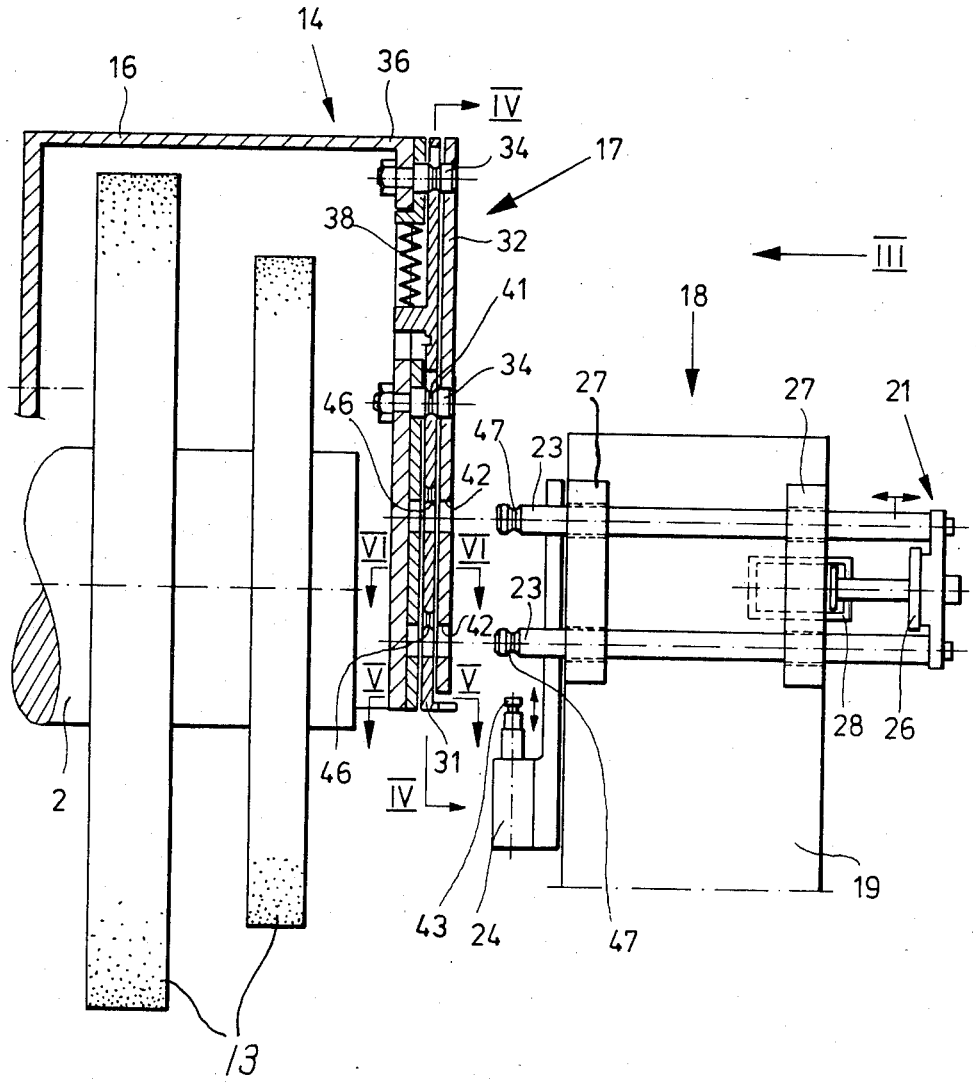
FIG. 2 is an enlarged fragmentary vertical sectional view as seen in the direction of arrows from the line II—II of FIG. 1, the cover of the protective enclosure being attached to the hood-shaped component of the enclosure and two discrete grinding wheels being mounted on the tool holder.

Referring first to FIGS. 1 and 2, there is shown a machine tool which constitutes a surface grinding machine including a frame for a stationary tool magazine 12, a mobile tool holder 2 in the form of a rotatable horizontal spindle and many other parts. The frame includes a base or bed 6 and an upright column 1 for a carrier 3 which is movable up and down and supports the spindle 2. The front end portion of the spindle 2 (this is the lower end portion, as viewed in FIG. 1) is provided with a suitable clamping device which can releasably engage and hold a hub 4 for one or more grinding wheels 13 so that the grinding wheels are compelled to share the angular movements of the spindle 2 as well as the movements of the spindle carrier 3 at right angles to the plane of FIG. 1. A suitable clamping device is disclosed, for example, in commonly owned German Offenlegungsschrift No. 32 46 168.

The base 6 supports a platform or support 7 which is reciprocable in a horizontal plane in parallelism with the axis of the spindle 2 (note the double-headed arrow Z in FIG. 1). The guide means for the platform 7 are shielded from dust and other contaminants by suitable bellows 8. The platform 7 supports a table 9 which is movable relative thereto in a horizontal plane in directions indicated in FIG. 1 by a double-headed arrow X along guide means which are concealed by bellows 11. The table 9 supports a suitable work holder which is not specifically shown in the drawing because its construction forms no part of the invention. The work holder can support one or more workpieces and can be provided with means for moving the workpiece or workpieces relative to the table.

The stationary magazine 12 can accommodate a supply of spare or worn grinding wheels 13 and is laterally adjacent to the column 1 and tool spindle or tool holder 2. A tool changing device 18 on the table 9 is mounted for movement between a tool changing position (shown in FIGS. 1 and 2) in front of the spindle 2 and a second position in which the grinding wheel or wheels carried by a retaining mechanism 22 of the tool changing device 18 are adjacent to the magazine 12. The magazine 12 can store a supply of identical or different grinding wheels.

The frame of the grinding machine further supports a protective enclosure 14 including a substantially hood-shaped component 16 which is affixed to the column 1 of the frame or to the spindle carrier 3 (and can be considered as an element of the frame), and a detachable portion in the form of a substantially plate-like cover 17 which is separably but firmly secured to the component 16 when the grinding machine is in actual use. The enclosure 14 may but need not be at least partially transparent or it may be provided with one or more window panes to allow for observation of the material removing operation which takes place when the workpiece on the table 9 is moved into engagement with the grinding wheel or wheels 13 on the spindle 2 and/or vice versa.

The exact construction of the tool changing device 18 on the table 9 forms no part of the present invention. As mentioned above, this device comprises a retaining mechanism 22 which can releasably hold the hub 4 for one or more grinding wheels 13 when the aforementioned clamping mechanism at the front end of the spindle 2 is deactivated so that it releases the hub 4 and allows for its transfer axially of and away from the spindle 2 prior to movement of the tool changing device 18 from the tool changing position of FIGS. 1 and 2 to the aforementioned second position adjacent to the magazine 12. The means for effecting a relative movement between the tool changing device 18 and the spindle 2 can constitute the aforementioned table 9 or a carriage 19 which is preferably a part of the device 18 and is movable along the table 9 in directions indicated by the double-headed arrow X.

In accordance with a feature of the invention, the tool changing device 18 carriers a novel and improved supporting mechanism or unit 21 which is designed to accept, hold and retain the cover 17 preparatory to a transfer of tools between the mechanism 22 and the spindle 2. The detached cover 17 remains on or in the supporting unit 21 during transfer of one or more grinding wheels 13 from the spindle 2 onto the retaining mechanism 22 and/or vice versa and is reattached to the frame (i.e., to the hood-shaped component 16) after the carriage 19 completes its return movement from its second position in front of the stationary tool magazine 12.

The supporting unit 21 comprises four parallel horizontal carriers 23 in the form of studs which are mounted on the carriage 19 of the tool changing device 18 and are connected to each other by an upright platen 26. The front end portions of the carriers 23 can enter openings 42 which are provided therefor in the lower portion of the cover 17 when the platform 7 is moved toward the column 1 in order to advance the entire supporting unit 21 toward the spindle 2 and/or when a fluid-operated motor 28 (preferably a double-acting hydraulic cylinder and piston unit) is actuated to move the platen 26 and its carriers 23 toward the hood-shaped component 16 of the enclosure 14 while the tool changing device 18 dwells in the tool changing position. The supporting unit 21 further comprises two actuating means in the form of upright fluid-operated motors 24 which are mounted on the carriage 19 and each of which preferably constitutes a double-acting hydraulic cylinder and piston unit. The purpose of the motors 24 is to disengage the cover 17 from the component 16 of the enclosure 14 as well as to lock the cover 17 to the carriers 23 of the supporting unit 21. The carriage 19 is provided with guides 27 for the carriers 23; the carriers slide relative to the respective guides 27 in response to actuation of the motor 28 whose cylinder is mounted on the rear guide 27 and whose piston rod is affixed to the platen 26. The axis of the piston rod in the motor 28 coincides with or is parallel to the axis of the spindle 2.

Figure 3:
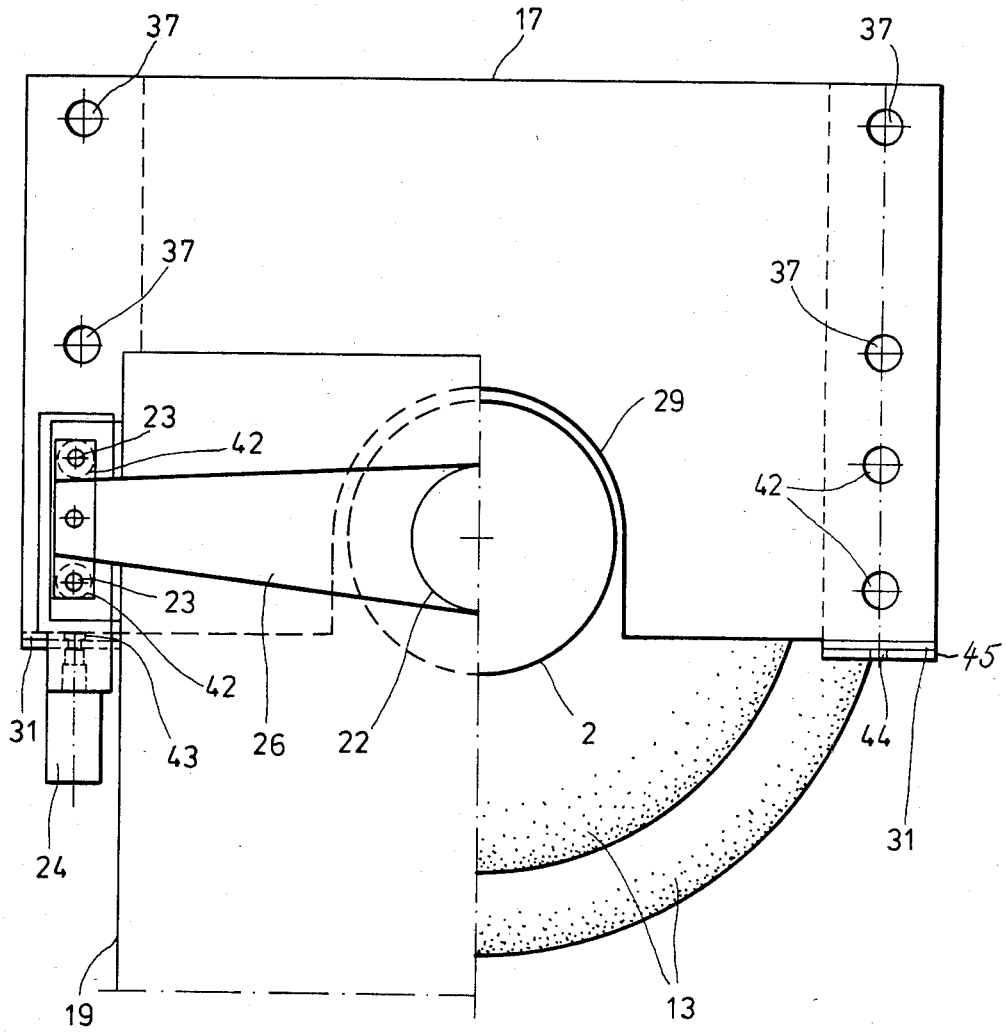
FIG. 3 is a fragmentary front elevational view as seen in the direction of arrow III in FIG. 2, showing the cover of the protective enclosure, portions of the two grinding wheels and a portion of the supporting means for the cover.
Figure 4:
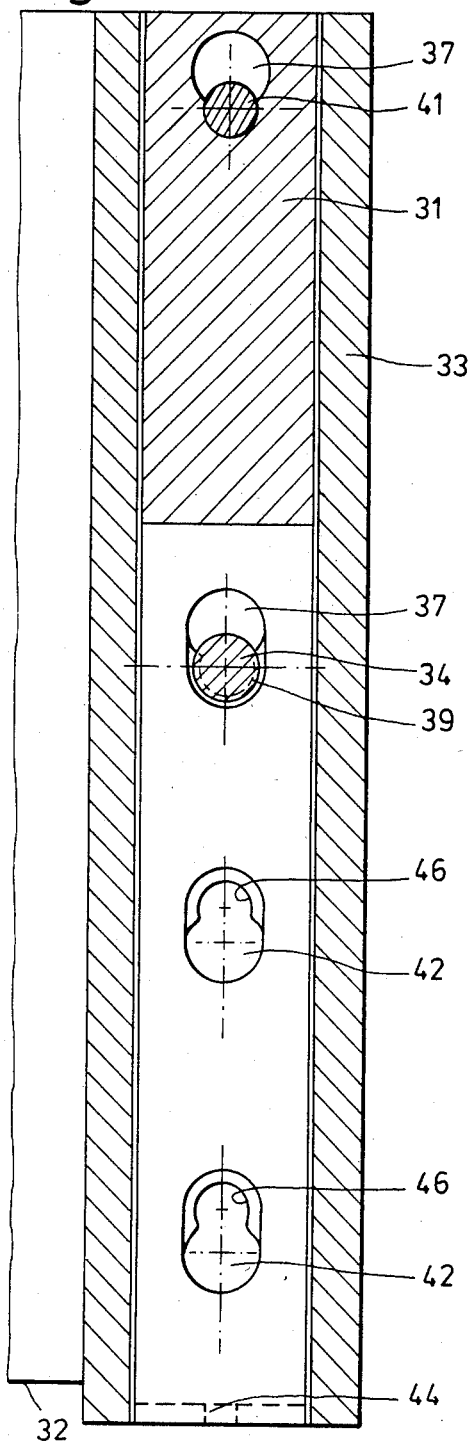
FIG. 4 is an enlarged fragmentary vertical sectional view as seen in the direction of arrows from the line IV—IV of FIG. 2 and shows one of the locking members which releasably secure the cover to the hood-shaped component of the protective enclosure or to the carriers of the supporting means.

As can be seen in FIG. 3, the lower portion of the cover 17 is formed with a relatively large cutout 29 which allows the retaining mechanism 22 of the tool changing device 18 to move toward or away from the spindle 2, i.e., to engage the hub 4 for one or more grinding wheels 13 and to retract such hub from the spindle upon deactivation of the aforementioned clamping mechanism at the front end of the spindle, or to move a fresh hub 4 toward and into engagement with such clamping mechanism. As mentioned above, the details of the tool changing device 18, except that it serves as a means for mounting the supporting unit 21, form no part of the invention.

Figure 5:
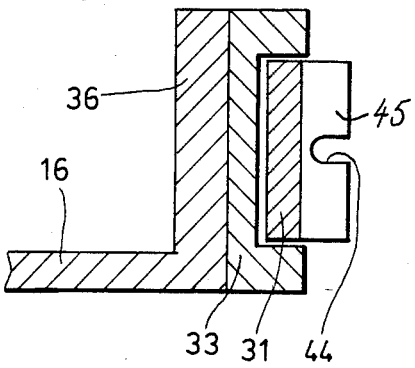
FIG. 5 is an enlarged fragmentary horizontal sectional view of the protective enclosure and of one of the locking members as seen in the direction of arrows from the line V—V of FIG. 2.
Figure 6:
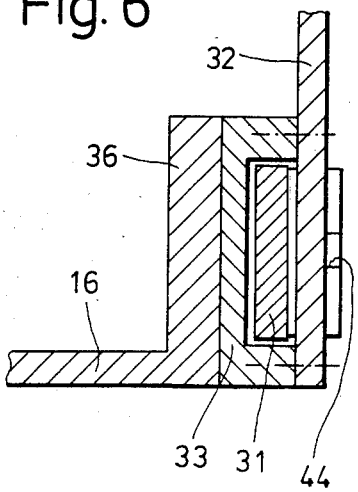
FIG. 6 is an enlarged fragmentary horizontal sectional view of the enclosure and one of the locking members as seen in the direction of arrows from the line VI—VI of FIG. 2.

The cover 17 comprises an outer plate 32 which faces the supporting unit 21 and is located in front of two vertically reciprocable locking bolts 31 each of which is in register with one pair of carriers 23 when the tool changing device 18 dwells in the position of FIG. 1 or 2. The locking bolts 31 are reciprocable between the front plate 32 and a rear portion 33 of the cover 17. The rear portion 33 serves as a guide for the locking bolts 31 and is screwed or otherwise secured to the plate 32. The hood-shaped component 16 of the enclosure 14 has two spaced-apart upright inwardly extending flanges 36 (see FIGS. 2, 5 and 6) which carry forwardly extending stubs 34 extending into complementary openings 37 of the cover 17 when the latter is locked to the component 16. The locking action is performed by the bolts 31 which are biased upwardly, as viewed in FIG. 2, by prestressed coil springs 38 mounted on the cover 17 and acting against the upper end portions of the locking bolts. The springs 38 tend to move the locking bolts 31 upwardly so that a circumferential constriction 41 of each stub 34 is then received in a narrower portion of the respective slot 39 in the corresponding locking bolt 31. The slots 39 register with the respective openings 37 of the cover plate 32.

In order to transfer the cover 17 from the flanges 36 of the component 16 onto the carriers 23, the device 18 is moved to the tool changing position of FIG. 1 and the motor 28 is actuated to move the retaining mechanism 22 through the cutout 29 of the cover 17 (which, at such time, is still locked to the stubs 34 on the flanges 36 by the bolts 31) as well as to move the carriers 23 into the corresponding openings 42 of the cover 17. The clamping mechanism at the front end of the spindle 2 releases the hub 4 of the grinding wheel or wheels 13 which were used up to such time and the mechanism 22 is actuated to engage and hold the hub 4 so that the latter is ready to share the movement of the mechanism 22 axially of and away from the spindle 2 in response to actuation of the motor 28 for the purpose of moving the mechanism 22 and the carriers 23 to the predetermined positions shown in FIG. 1. The upper end portions 43 of the piston rods of the motors 24 are caused to enter relatively narrow slots 44 in the forwardly extending lugs 45 of the respective locking bolts 31 as soon as the piston rod of the motor 28 completes its forward stroke. Actuation of the motors 24 thereupon entails a downward movement of the respective locking bolts 31 against the opposition of the corresponding springs 38 and disengagement of the locking bolts 31 from the corresponding sets of stubs 34. At the same time, constrictions 47 of the carriers 23 are surrounded by the narrower portions of openings or holes 46 in the respective locking bolts 31 so that the bolts then ensure that the cover 17 is held on the carriers 23 and is compelled to share all axial movements of such carriers in response to actuation of the motor 28 as long as the motors 24 continue to pull their piston rods downwardly in order to cause the springs 38 to store additional energy. In the next step, the motor 28 is actuated to move the carriers 23 and the cover 17 thereon axially of and away from the spindle 2; such movement is shared by the retaining mechanism 22 which moves the hub 4 with one or more grinding wheels 13 thereon axially of and away from the spindle 22. The motor for the carriage 19 is then started to move the tool changing device 18 to the second position next to the stationary tool magazine 12 which receives the hub 4 from the retaining mechanism 22 and the latter then accepts a fresh hub with one or more grinding wheels 13 from the magazine prior to return movement of the device 18 to the tool changing position of FIG. 1. The cover 17 shares the movements of the tool changing device 18 toward and again away from the tool magazine 12 and is reattached to the component 16 of the protective enclosure 14 simultaneously or substantially simultaneously with the transfer of a fresh hub 4 onto the spindle 2. The motors 24 are thereupon actuated to allow the springs 38 to return the bolts 31 into locking engagement with the stubs 34 on the flange 36 of the component 16 so that the cover 17 is again locked to the component 16 and the machine tool is ready for use with the freshly delivered grinding wheel or wheels 13 as soon as the motor 28 retracts the retaining mechanism 22 and also the carriers 23 which are then free to slide out of the respective openings 42 of the cover 17 because the locking bolts 31 are held in the upper end positions in which they are disengaged from the carriers 23 but are engaged with the stubs 34.

It is also within the purview of the invention to construct and assemble the supporting unit 21 in such a way that it can detach the entire enclosure 14 from the frame of the machine tool and to support the thus detached enclosure 14 during the interval which is required to detach one or more previously used tools from their holder and to replace such tool or tools with one or more fresh tools. However, it has been found that it normally suffices to detach only a portion (cover 17) of the enclosure 14 and to leave the remaining portion (component 16) of the enclosure on the frame.

It is also possible to mount the magazine 12 on the tool changing device 18 so that the magazine shares all movements of such device relative to the tool holder or tool holders of the machine tool. Such magazine is disclosed in the commonly owned German Offenlegungsschrift No. 32 46 168. In such machine tools, each of the tools which are stored in the magazine on the tool changing device can be provided with its own protective enclosure (this again involves detachment of the enclosure from the frame with detachment of a tool from its holder and reattachment of such enclosure to the frame in response to attachment of the tool to the holder), or the supporting means 21 (or analogous supporting means) can be provided on the mobile tool magazine. The arrangement (with a stationary tool magazine) which is shown in the drawing is preferred at this time because the weight of the tool changing device 18 is reduced considerably in view of the fact that it need not include or carry a magazine for a plurality of tools.

The number of carriers 23 for the cover 17 can be reduced to less than four or increased to five or more without departing from the spirit of the invention. Moreover, the locking bolts 31 can be replaced with other types of locking devices which releasably secure the cover 17 to the component 16 or to the carrier means of the supporting means 21. Still further, the machine tool can be equipped with first locking means for releasably securing the cover 17 to the component 16 and with second locking means for releasably securing the cover 17 to the carrier means 23 or to analogous carrier means when the first locking means is inactive. The illustrated locking bolts 31 are preferred at this time because they contribute to simplicity and compactness of the supporting means 21.

An important advantage of the improved machine tool is that there is no need to allot a space next to the tool holder (i.e., the spindle 2 of the illustrated grinding machine) for accommodation of a portion of or the entire protective enclosure 14 during exchange of tools. Instead, a portion of or the entire enclosure can be transferred onto and held on the tool changing device 18 during transfer or one or more tools from the tool holder into or onto the tool changing device and vice versa. Another important advantage of the improved machine tool is that the operation of the supporting unit 21 (for the purpose of detaching the cover 17 from and/or attaching the cover 17 to the component 16 of the protective enclosure 14) can be automated to any desired extent so that the detachment of cover 17 from and its reattachment to the component 16 can be effected in a predetermined sequence with the steps which must be carried out for the purpose of exchanging tools between the holder and the magazine. The space on or adjacent to the tool changing device 18 (to accommodate the cover 17) is normally available anyway, and this device is moved out of the way when the machine tool is in actual use so that the feature that the cover 17 can be temporarily transferred onto the device 18 allows for better utilization of the space around the tool holder when the machine tool is in actual use.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a machine tool, such as a grinding machine, the combination of a frame; a tool holder in said frame; a protective enclosure provided on the frame for the tool on said holder; a tool changing device provided on said frame; means for effecting a relative movement between said device and said holder so that said device can assume with reference to said holder a tool changing position in which a tool can be transferred between said device and said holder; and means for temporarily supporting at least a portion of said enclosure during transfer of tools between said device and said holder in a predetermined position such as to afford access to said holder, said supporting means being provided on said device.

2. The combination of claim 1, wherein said supporting means includes means for detaching said portion of said enclosure from and for reattaching said portion of the enclosure to said frame.

3. The combination of claim 1, wherein said enclosure comprises a substantially-hood shaped component on said frame and a cover which constitutes said portion of said enclosure, said supporting means comprising means for detaching said portion from and for reattaching said portion to said component.

4. The combination of claim 1, wherein said supporting means comprises carriers provided on said device and means for engaging said carriers with and for disengaging said carriers from said portion of said enclosure in the tool changing position of said device.

5. The combination of claim 4, wherein said supporting means further comprises means for moving said carriers and said portion of said enclosure toward and away from said predetermined position.

6. The combination of claim 1, further comprising a tool magazine, said means for effecting relative movement including a carriage forming part of said device and movable between said tool changing position and a second position in which said device is adjacent to said magazine, said supporting means comprising a plurality of carriers provided on said carriage and arranged to releasably support and hold said portion of said enclosure.

7. The combination of claim 6, wherein said device further comprises tool retaining means and said carriers include at least one pair of parallel elongated carriers flanking said retaining portion.

8. The combination of claim 1, further comprising means for separably locking said portion of said enclosure to said frame, said supporting means including means for disengaging said locking means in the tool changing position of said device, carrier means for releasably supporting the unlocked portion of said enclosure, and means for moving said carrier means and the portion of said enclosure thereon to and from said predetermined position.

9. The combination of claim 1, further comprising a plurality of locking members provided on said portion of said enclosure for releasably securing said portion of said enclosure to said frame, said supporting means including carriers provided on said device and arranged to engage said portion of said enclosure in the tool changing position of said device and means for actuating said locking members so as to disengage said members from said frame and simultaneously secure said portion of said enclosure to said carriers by way of said locking members or vice versa.

10. The combination of claim 9, wherein said locking members include reciprocable locking bolts mounted on said portion of said enclosure, said portion of said enclosure having apertures for reception of said carriers in the tool changing position of said device.

11. The combination of claim 9, further comprising means for yieldably biasing said locking members into engagement with said frame.

12. The combination of claim 11, wherein said actuating means comprises means for overcoming the bias of said biasing means in the course of disengagement of said locking members from said frame and simultaneous engagement of said locking members with said carriers.

13. The combination of claim 12, wherein said enclosure further comprises a substantially hood-shaped component which is affixed to said frame and said biasing means includes resilient means provided on said portion and arranged to urge said locking members into engagement with said component.

14. The combination of claim 1, wherein said tool holder includes a rotatable spindle for at least one grinding wheel.

15. The combination of claim 14, wherein said supporting means includes means for moving said portion of said enclosure to and from said predetermined position in the axial direction of said spindle.

16. The combination of claim 15, wherein said portion of said enclosure comprises a substantially plate-like cover.

17. The combination of claim 14, wherein said device includes a carriage which constitutes said means for effecting relative movement between said device and said tool holder and is reciprocable relative to said frame along a substantially horizontal path at right angles to the axis of said spindle.

* * * * *